US008613119B2

(12) United States Patent
Hsu

(10) Patent No.: US 8,613,119 B2
(45) **Date of Patent: *Dec. 24, 2013**

(54) ADJUSTABLE MATTRESS

(76) Inventor: Han-Chung Hsu, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/534,228

(22) Filed: Jun. 27, 2012

(65) Prior Publication Data

US 2013/0000049 A1 Jan. 3, 2013

(30) Foreign Application Priority Data

Jul. 1, 2011 (TW) ..... 100212059 U

(51) Int. Cl.
*A61G 7/00* (2006.01)

(52) U.S. Cl.
USPC ..... 5/600; 5/697; 5/936; 5/710

(58) Field of Classification Search
USPC ..... 5/690, 697, 936, 716, 727, 710; 267/177, 170
See application file for complete search history.

(56) References Cited

U.S. PATENT DOCUMENTS

| | | | | | |
|---|---|---|---|---|---|
| 3,252,170 | A * | 5/1966 | Frye | ..... | 5/697 |
| 4,222,137 | A * | 9/1980 | Usami | ..... | 5/727 |
| 6,003,178 | A * | 12/1999 | Montoni | ..... | 5/690 |
| 6,487,738 | B1 * | 12/2002 | Graebe | ..... | 5/719 |
| 7,458,121 | B1 * | 12/2008 | Hsu | ..... | 5/716 |
| 7,934,277 | B1 | 5/2011 | Shu | | |
| 2008/0276377 | A1 * | 11/2008 | Hsu | ..... | 5/727 |

* cited by examiner

*Primary Examiner* — Peter M Cuomo
*Assistant Examiner* — Brittany Wilson
(74) *Attorney, Agent, or Firm* — Ming Chow; Sinorica, LLC

(57) ABSTRACT

An adjustable mattress comprises a carrier and a foundation. The carrier has a bed surface, a bottom surface, and a plurality of first flexible members and second flexible members distributed in the carrier. One of the first flexible members and one of the second flexible members are encased in a flexible support unit. The bottom of the carrier is disposed on the foundation. The two bearing points in a stretchable direction of the first flexible member contact the bed surface and the bottom surface respectively, and one end of the second flexible member protrudes from or is concealed in the bottom surface of the carrier. The foundation has a moving plate and a lifting device. The moving plate can be lifted by the lifting device to an active position to support weights from the bed surface with the first flexible members.

10 Claims, 9 Drawing Sheets

ADJUSTABLE MATTRESS

The current application claims a foreign priority to the application of Taiwan 100212059 filed on Jul. 1, 2011.

BACKGROUND OF THE INVENTION

1. Field of the Invention

The present invention relates to a mattress, particularly an adjustable mattress with supporting force regulated by second flexible members.

2. Description of the Prior Art

A case for a mattress's supporting force regulated with second flexible members shown in the patent application Ser. No. 12/877,275, MATTRESS STRUCTURE (hereinafter referred to as cited case 1), submitted on Sep. 8, 2010. Cited case 1 has major features as follows: A mattress structure is a mattress body and comprises: a fixed plate, which has a plurality of flexible accommodating holes and at least one first flexible member; a moving plate, which has at least one second flexible member corresponding to the flexible accommodating hole, the moving plate is below the fixed plate and has a distance with the fixed plate for moving; at least one lifting device, which is combined with the bottom of the moving plate, the moving plate and the second flexible member move up and down via the lifting device in order to let that the second flexible member penetrates through the flexible accommodating holes and protrudes out of the top surface of the fixed plate.

The patent application herein which is different from cited case 1 is to combine and accommodate first flexible members and second flexible members in a carrier and each of the first flexible members and each of the second flexible members are encased in packages to become a flexible support unit. In a regular state, one of the first flexible members sustain weight of the bed surface by means of two bearing points in a stretchable direction contacting both the bed surface and the bottom surface; one of the second flexible member allows its bottom to protrude from or be concealed in the carrier's bottom surface regularly. In addition, the bottom surface of the carrier can be a wire netting structure and each of the first flexible members is fastened to the bottom surface by means of fastener components without exposure of the first flexible member due to the shifted package.

SUMMARY OF THE INVENTION

The present invention provides an adjustable mattress which allows a user to freely adjust the mattress's supporting force.

The present invention in one embodiment comprises a carrier and a foundation. The carrier has a bed surface, a bottom surface, and a plurality of first flexible members and a plurality of second flexible members uniformly distributed in the carrier wherein each of the first flexible members and each of the second flexible members are encased in a flexible support unit. The foundation on which the carrier is stacked sustains the bottom surface of the carrier. In a regular state, one of the first flexible members sustains weight of the bed surface by means of two bearing points in a stretchable direction contacting both the bed surface and the bottom surface. Regularly, the bottom of one of the second flexible members protrudes from or is concealed in the bottom surface of the carrier. The foundation has a moving plate and a lifting device. The moving plate can be lifted by the lifting device to an active position to support the bottom of the second flexible members, so the second flexible members can support weight from the bed surface with the first flexible members. As such, the adjustable mattress with regulatory supporting force is offered herein.

According to one embodiment of the present invention for each of the flexible support units, the second flexible member which extrudes from the bottom surface regularly keeps a certain distance between its bottom and the moving plate's surface and allows its top to touch the bed surface and its bottom to contact the moving plate driven by the lifting device so that the second flexible member, which has been lifted to an active position, as well as the first flexible member collectively sustain weight of the bed surface for regulating the mattress's supporting force.

According to an alternative embodiment of the present invention for each of the flexible support units, the second flexible member which extrudes from the bottom surface regularly allows its bottom to touch the moving plate's surface and keeps a certain distance between its top and the bed surface so that the second flexible member which has been lifted by the moving plate until an active position via effect of the lifting device makes its top touch the bed surface and unites the first flexible member to collectively sustain weight of the bed surface for regulating the mattress's supporting force.

According to one embodiment of the present invention, the lifting device comprises a motor and bolts.

According to one embodiment of the present invention, the lifting device comprises gasbags, air manifolds and an air compressor.

According to one embodiment of the present invention, a height sensor inside the foundation is used to detect a shift of the moving plate between a current position and a regular one so that the lifting device is disabled for stopping movement of the moving plate which has been lifted until a top position.

It can be seen from above descriptions that the present invention of an adjustable mattress features weight of the bed surface regularly sustained by the first flexible members or by the first flexible members and the second flexible members lifted until an active position by one user who depends on requirements to freely control the moving plate. As such, a proper supporting force of the mattress can be unlimitedly regulated by one user for improved sleep quality.

The advantages, effects and embodiments in terms of the present invention are further interpreted in detailed descriptions and drawings as follows.

BRIEF DESCRIPTIONS OF THE DRAWINGS

DETAILED DESCRIPTIONS OF THE PREFERRED EMBODIMENTS

Figure 1:
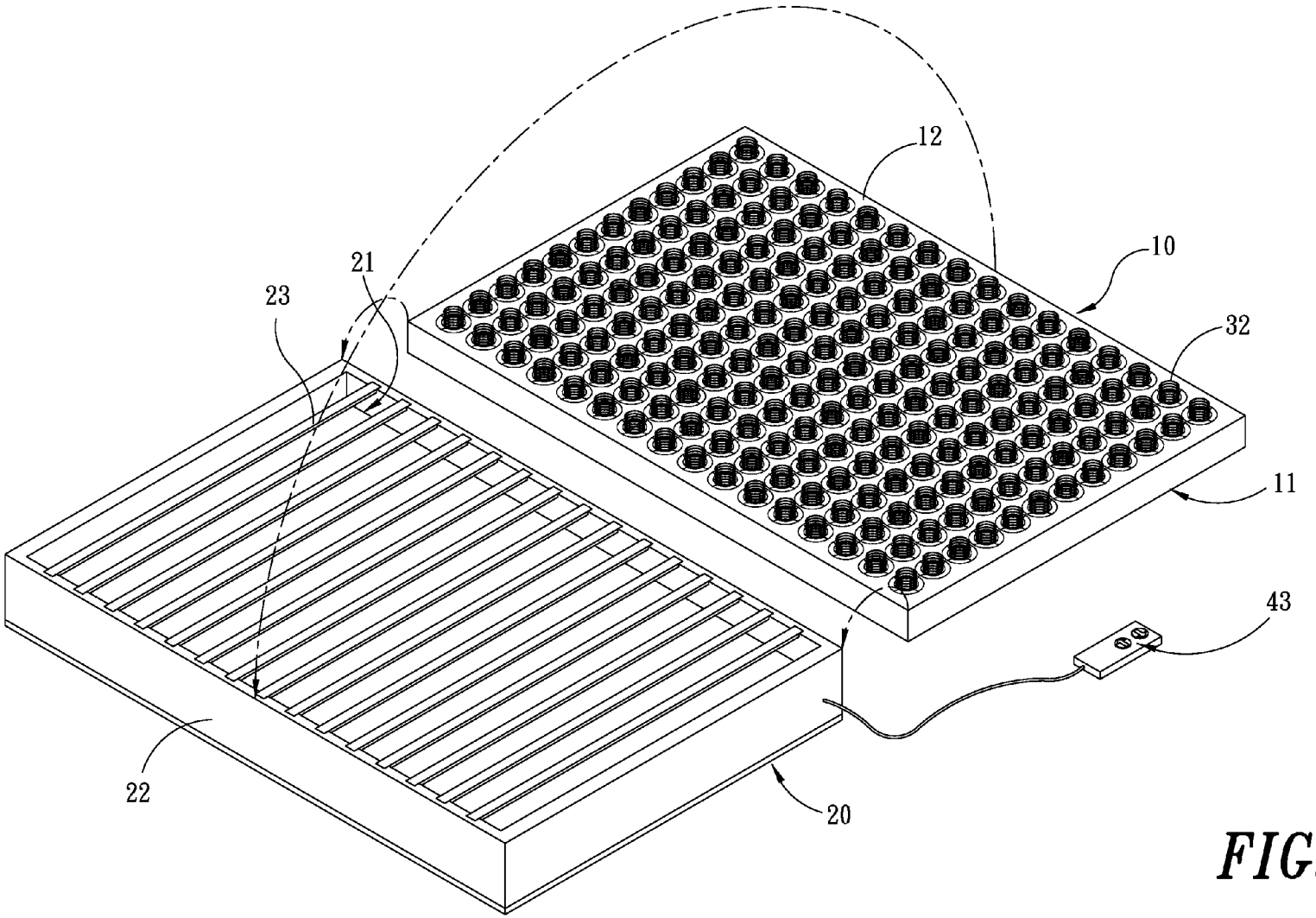
FIG. 1 is a perspective view of the present invention of an adjustable mattress in one embodiment.

As shown in FIG. 1, the present invention of an adjustable mattress in one embodiment comprises a carrier 10 and a foundation 20.

Figure 2:
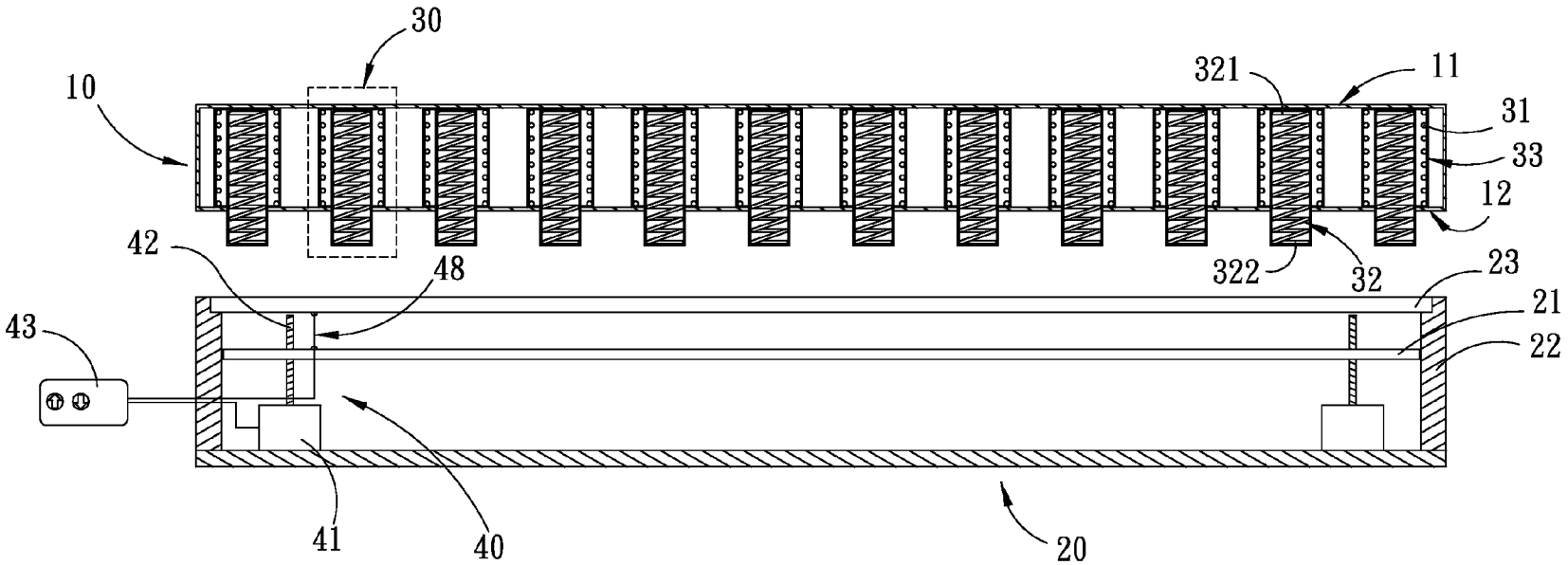
FIG. 2 is a sectional view of the adjustable mattress in FIG. 1 and illustrates the structure in the foundation.

The carrier 10 has a bed surface 11, a bottom surface 12 (as shown in FIG. 2), a plurality of first flexible members 31, and a plurality of second flexible members 32. The first flexible members 31 and the second flexible members 32 are uniformly distributed in the carrier 10. Each of the first flexible members 31 and each of the second flexible members 32 are encased in packages 33 to form a flexible support unit 30. Each of the first flexible members 31 has a first bearing point and a second bearing point in a stretchable direction. The first bearing point connects to the bed surface 11 and the second bearing point connects to the bottom surface 12 to support a weight from the bed surface 11. The bottom 322 of each the second flexible member 32 protrudes from or is concealed in a bottom surface 12 of the carrier 10.

Figure 3:
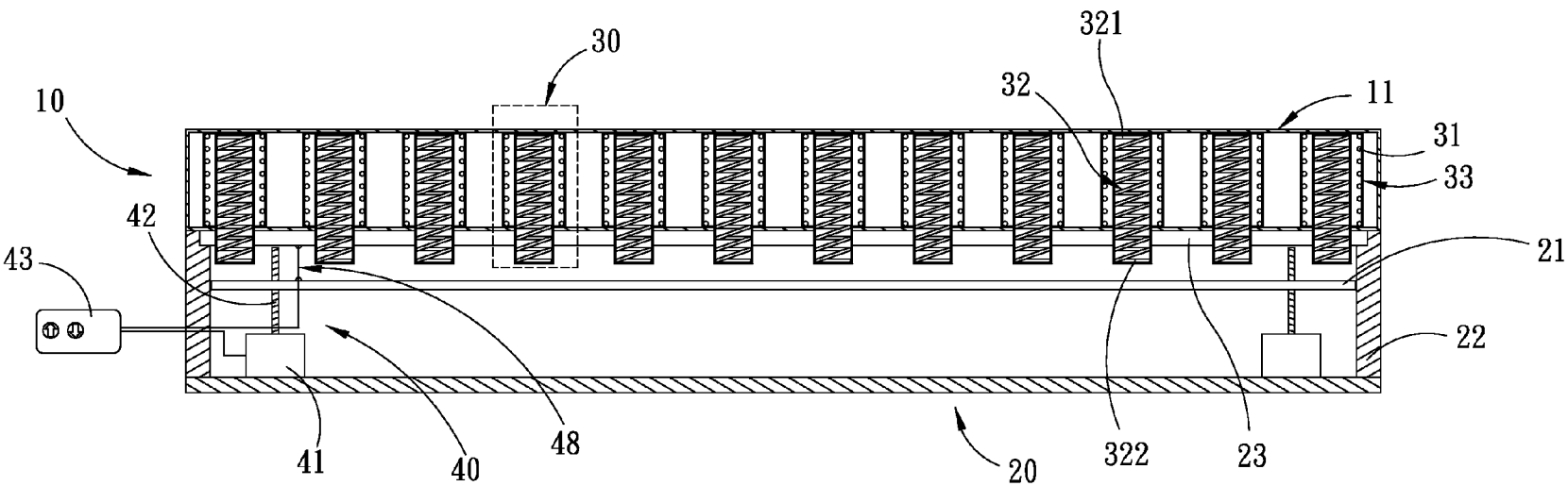
FIG. 3 illustrates the structure of the adjustable mattress in FIG. 2 and illustrates the carrier stacked on the foundation.

The foundation 20 has a moving plate 21 and a lifting device 40. The foundation 20 supports the bottom surface 12 of the carrier 10, which is stacked on the foundation 20 (as shown in FIG. 3). In one embodiment, the foundation 20 comprises a plurality of vertical walls 22 assembled one another and a plurality of crossbars 23 transversely placed on top edges of the vertical walls 22. The vertical walls 22 enclose a rectangle supporting the bottom surface 12 of the carrier 10. The crossbars 23 are spaced at intervals on top edges of the vertical walls 22 support bottoms of the first flexible members 31 by means of the bottom surface 12 of the carrier 10 stacked over the foundation 20 and allow the bottom 322 of each of the second flexible members 32 to exactly penetrate a space between any both of the crossbars 23. The moving plate 21 inside the foundation 20 is driven by the lifting device 40 to move toward or away from the carrier 10. The lifting device 40 drives the moving plate 21 toward the carrier 10 and lifts the second flexible members 32 until an active position so that weight of the bed surface 11 is supported by both the first flexible members 31 and the second flexible members 32.

Figure 5:
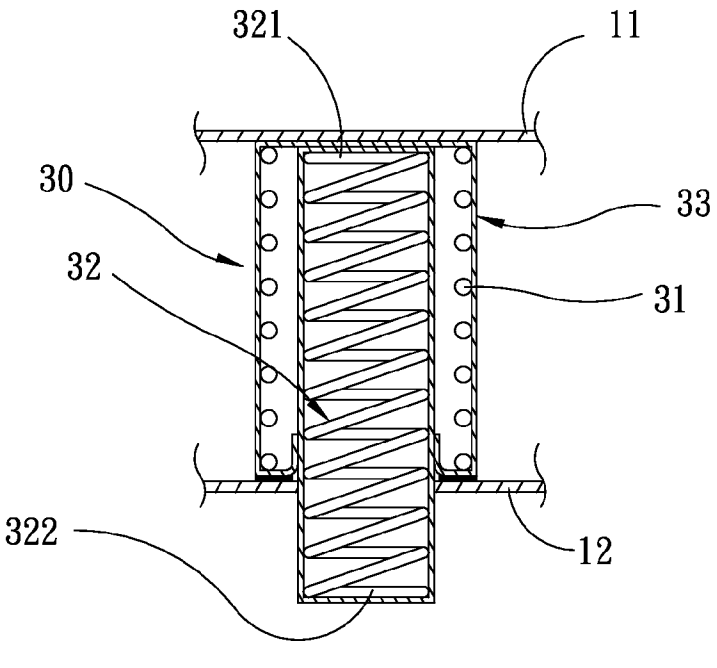
FIG. 5 is a sectional view of the flexible support unit in one embodiment and illustrates the package adhering to the bed surface and the bottom surface of the carrier.

Each of the first flexible members 31 (or the second flexible members 32) is a spring in one embodiment. As shown in FIG. 5, the first flexible member 31 and the second flexible member 32 are encased by the packages 33 wherein the second flexible member 32 whose its external diameter (axial length) is less than (greater than, equal to, or less than) the internal diameter (axial length) of the first flexible member 31 axially penetrates the center of the first flexible member 31 and has elastic force (or modulus of elasticity) identical to or different from that of the first flexible member 31 and the packages 33 optionally manufactured with a non-woven fabric or an alternative fabric avoids twists of the first flexible member 31 and the second flexible member 32, which influences elastic force of the two flexible members, and encapsulate both the first flexible member 31 and the second flexible member 32 into the flexible support unit 30.

Figure 6:
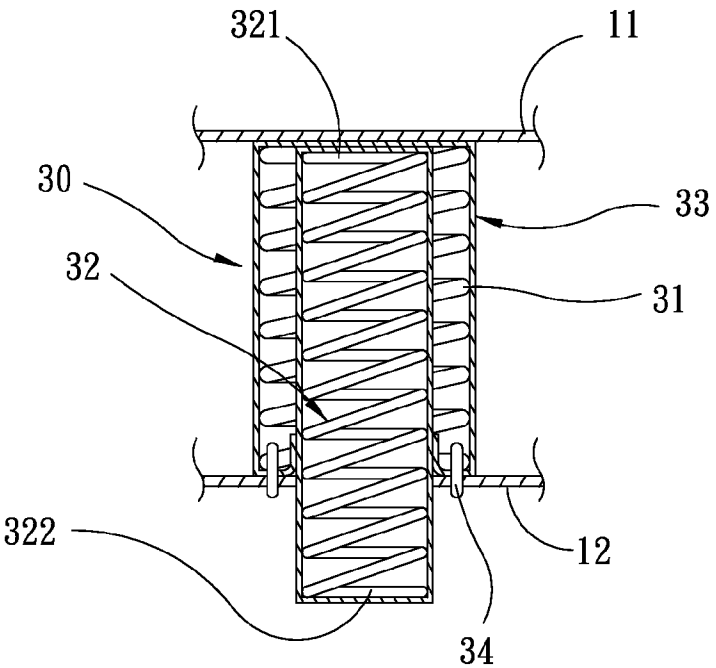
FIG. 6 is a sectional view of the flexible support unit in one embodiment and illustrates the first flexible member is fastened to the bed surface or the bottom surface by fastener components.

As shown in FIG. 5, the first flexible member 31 in its stretchable direction has two bearing points which contact the bed surface 11 and the bottom surface 12 and more specifically across the packages 33. In one embodiment, the packages 33 adhere to the bed surface 11 and the bottom surface 12 of the carrier 10 by means of adhesion force (viscose or hot-melt adhesive) and both the bed surface 11 and the bottom surface 12 are manufactured with robust fabrics; in an alternative embodiment, the bottom surface 12 of the carrier 1 is a wire netting structure and both the first flexible member 31 and the package 33 are fastened to the bed surface 11 or the bottom surface 12, each of which is based on wire nettings, by means of fastener components 34 (e.g., C-rings or metal wires) (FIG. 6).

Figure 4:
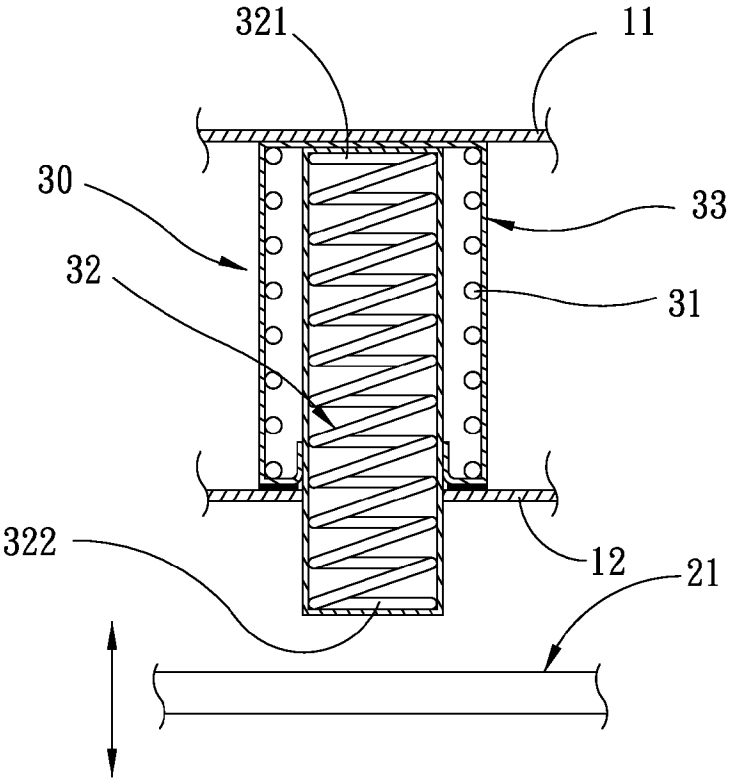
FIG. 4 is a sectional view of the flexible support unit in one embodiment wherein the bottom of the second flexible member is regularly separated from the moving plate by a specific distance.

In one embodiment (FIG. 4), the flexible support unit 30 allows the second flexible member 32 to protrude from the bottom 322 of the bottom surface 12 and to regularly keep a distance from the surface of the moving plate 21. In this context, the top 321 of the second flexible member 32 touches the bed surface 11 and the moving plate 21 is driven by the lifting device 40 toward the carrier 10 so that the surface of the moving plate 21 contact the bottom 322 of the second flexible member 32 for lifting the second flexible member 32 until an unfixed active position. Specifically, an active position is available in the beginning of the surface of the moving plate 21 touching the bottom 322 of the second flexible member 32 so that weight of the bed surface 11 is collectively sustained by the first flexible member 31 and the second flexible member 32 which has been lifted by the moving plate 21. The second flexible member 32, which is changeably compressed when it is lifted by the moving plate 21 until a different position, further unites the first flexible member 31 to effectively adjust a mattress's supporting force.

Figure 7:
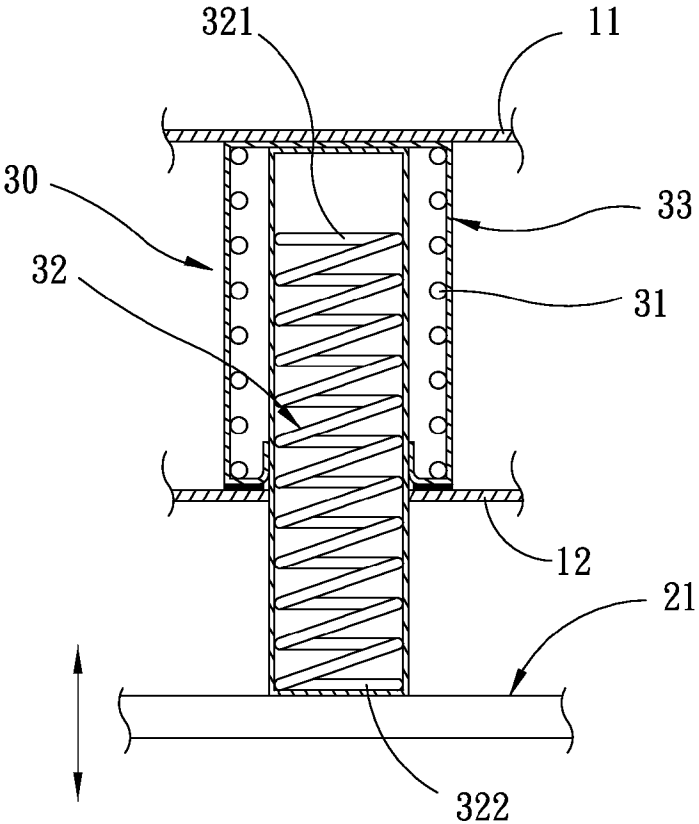
FIG. 7 is a sectional view of the flexible support unit in an alternative embodiment wherein the bottom of the second flexible member regularly touches the surface of the moving plate.

In one embodiment of the flexible support unit 30 (FIG. 7), the second flexible member 32 protrudes from the bottom 322 of the bottom surface 12, so as to regularly touch and be fixed on the surface of the moving plate 21 via adherence or fastening abovementioned. The moving plate 21, which is driven by the lifting device 40 toward the carrier 10, lifts the second flexible member 32 until an unfixed active position and allows the top 321 of the second flexible member 32 originally separated from the bed surface 11 to touch the bed surface 11 instead. Specifically, the so-called unfixed active position implies that an active position is available in the beginning of the top 321 of the second flexible member 32 touching the bed surface 11 so that weight of the bed surface 11 is collectively sustained by the first flexible member 31 and the second flexible member 32 which has been lifted by the moving plate 21. Accordingly, the second flexible member 32, which is changeably compressed when it is lifted by the moving plate 21 until a different position, further unites the first flexible member 31 to effectively adjust a mattress's supporting force.

In one embodiment, the lifting device 40 comprises a motor 41, bolts 42 and a controller 43 (FIG. 2) wherein the bolts 42 which are uniformly distributed in the foundation 20 and screwed onto the moving plate 21 are driven by the motor 41 under effect of the controller 43 for shifting the moving plate 21 toward or away from the carrier 10. For instance, the bolts 42 are directly driven by a torque motor in one embodiment or a reducer unit (e.g., reduction gears) under effect of the motor 41 in an alternative embodiment.

Figure 8:
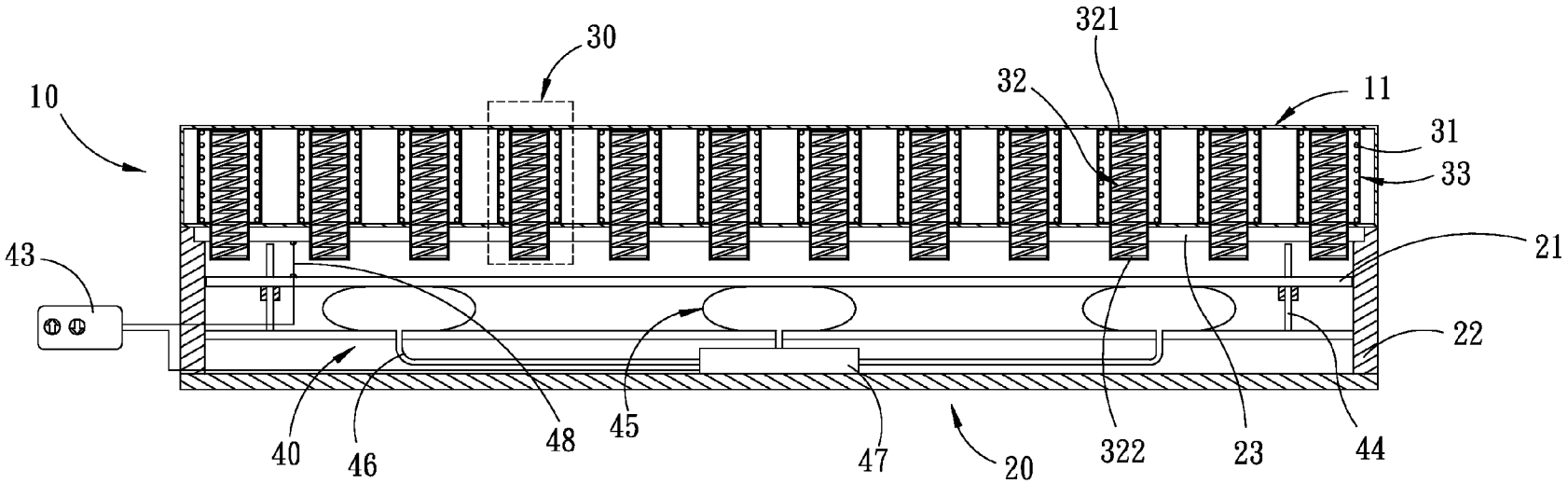
FIG. 8 is a sectional view of the adjustable mattress and illustrates the lifting device in one embodiment comprises a controller, a plurality of lead screws, a plurality of gasbags, air manifolds, and an air compressor.
Figure 9:
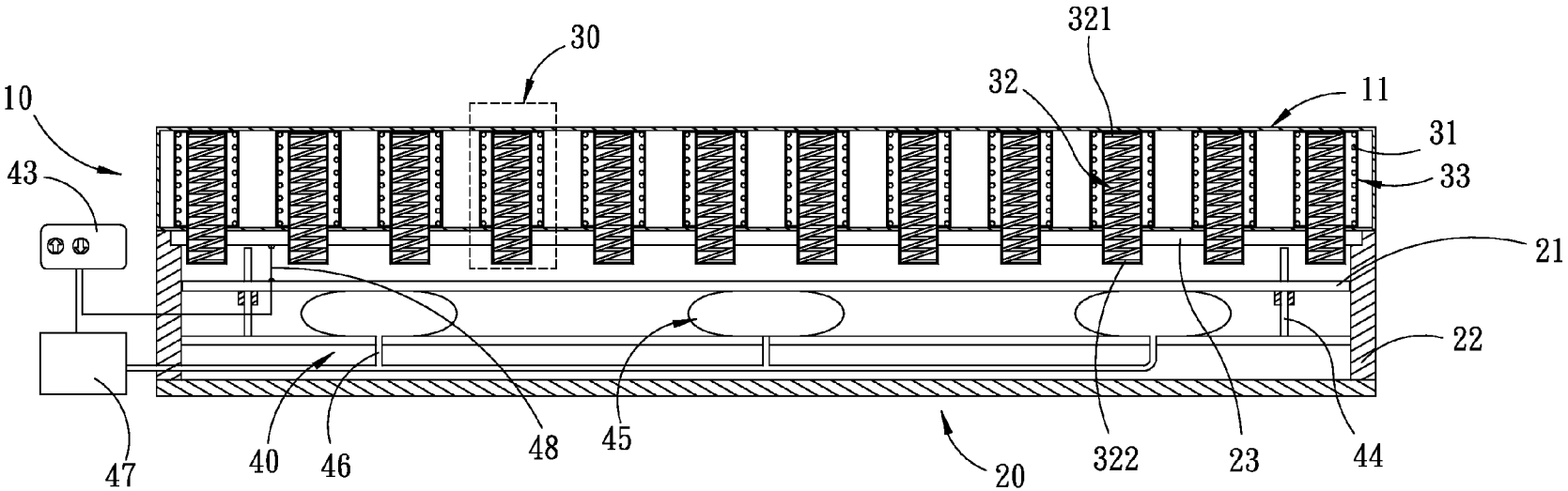
FIG. 9 is a sectional view of the adjustable mattress and illustrates the lifting device (FIG. 8) in an alternative embodiment wherein the air compressor is installed outside the foundation.

In an alternative embodiment (FIG. 8), the lifting device 40 comprises a controller 43, a plurality of lead screws 44, a plurality of gasbags 45, air manifolds 46 and an air compressor 47 wherein the lead screws 44 which are uniformly distributed in and penetrate the moving plate 21 are used in stably guiding the moving plate 21 toward or away from the carrier 10 and the gasbags 45 which are uniformly distributed under the moving plate 21 are inflated or deflated by the air compressor 47 under effect of the controller 43. In the context, the inflated gasbags 45 lift and shift the moving plate 21 toward the carrier 10; on the contrary, the deflated gasbags 45 allow the moving plate 21 to move away from the carrier 10. One of the second flexible members 32, which is changeably compressed when it is lifted by the moving plate 21 until a different position, further unites one of the first flexible members 31 to effectively adjust a mattress's supporting force. Furthermore, the air compressor 47 is directly installed inside the foundation 20 in one embodiment (FIG. 8) or outside the foundation 20 in an alternative embodiment (FIG. 9).

In one embodiment of the present invention, a height sensor 48 installed inside the foundation 20 (FIG. 6) is used to detect a shift of the moving plate 21 between a current position and a regular one so that the controller 43 receiving a signal of the moving plate 21 lifted until the top position stops movement of the lifting device 40 and the moving plate 21 to prevent the moving plate 21 or the lifting device 40 from faults.

Figure 10:
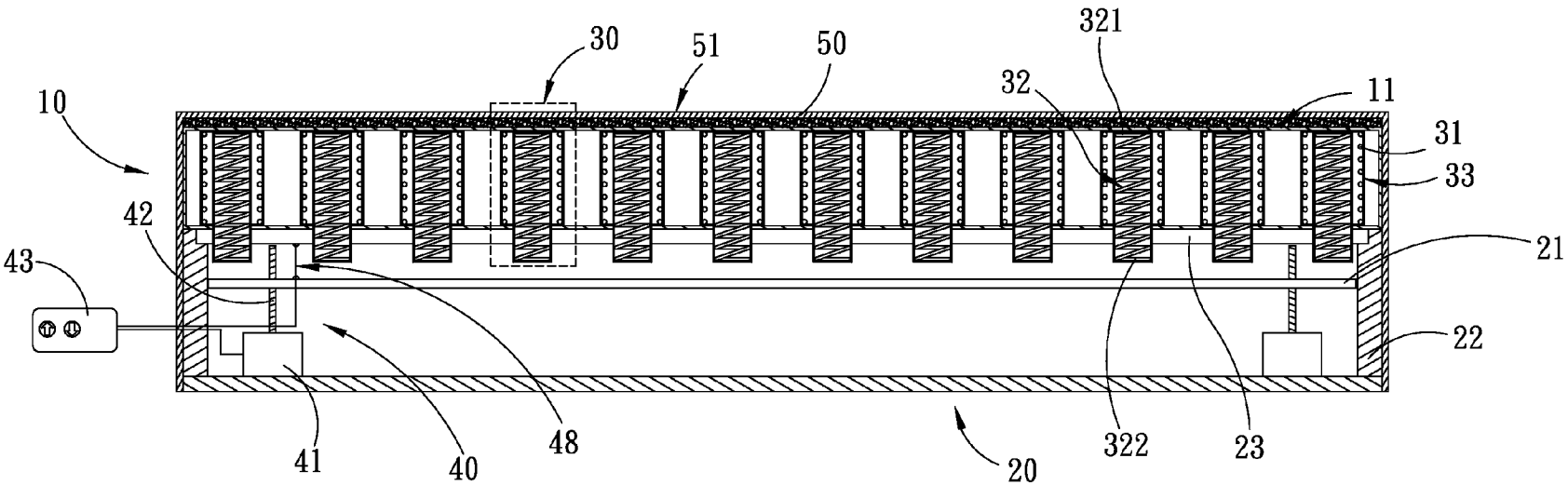
FIG. 10 is a sectional view of the adjustable mattress comprising the soft mattress and the bed clothing in a further embodiment.

In one embodiment, the present invention comprises a soft mattress 50 and bed clothing 51 (FIG. 10) wherein the soft mattress 50 which is manufactured with foam, latex or any buffer material for distributing pressures is stacked on the bed surface 11 of the carrier 10 and the bed clothing 51 wraps the soft mattress 50, the carrier 10 and the foundation 20 externally.

In addition, the abovementioned controller 43 is a remote controller.

Figure 11:
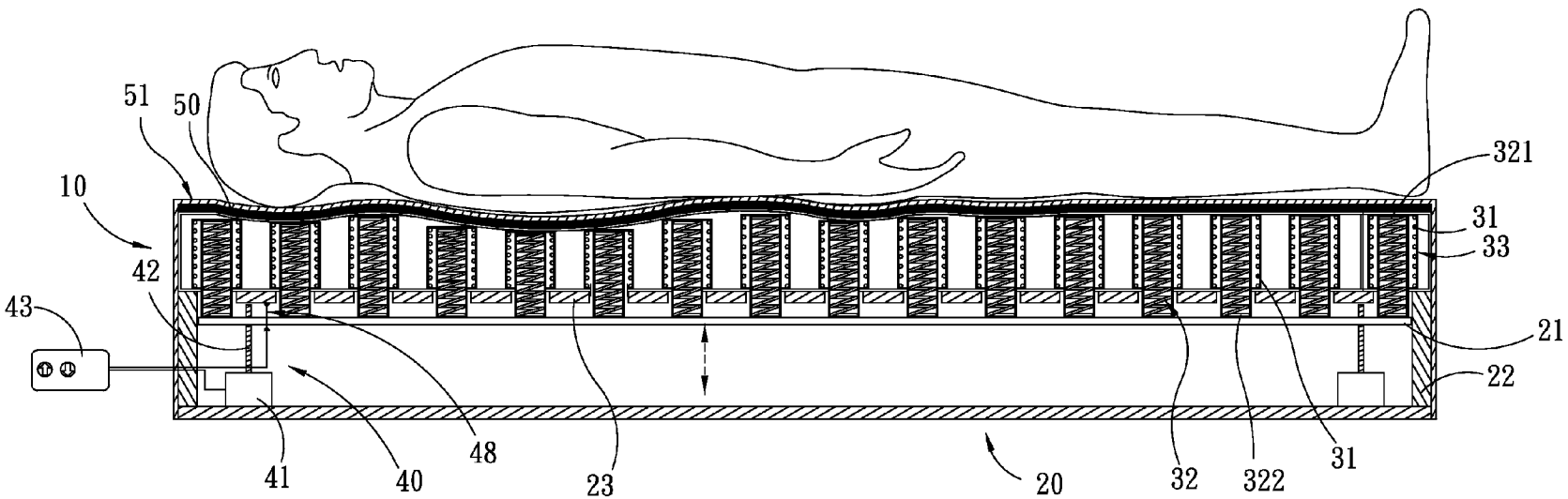
FIG. 11 is a sectional view of the adjustable mattress and illustrates a user lying on the bed surface and adjusting the mattress's supporting force by using the lifting device.

In regular employment for one user lying on the present invention of an adjustable mattress (FIG. 11), weight of the bed surface 11 is uniformly sustained by the first flexible members 31; in the case of one heavier user or insufficient supporting force, the controller 43 is operated to activate the lifting device 40 as well as the moving plate 21 so that one of the second flexible members 32 lifted until a different active position and compressed changeably unites one of the first flexible members 31 to sustain weight of the bed surface 11 and effectively adjust supporting force of the mattress.

Notwithstanding the foregoing, the embodiments disclosed for the present invention do not limit the present invention and any person skilled in the art may change or modify them without departing from the spirit and scope of the present invention. Therefore, the scope to be protected under the patent should refer to claims of the patent specifications.

What is claimed is:

1. An adjustable mattress, comprising:

a carrier having a bed surface, a bottom surface, a plurality of first flexible members, and a plurality of second flexible members, the plurality of first flexible members and the plurality of second flexible members uniformly distributed in the carrier, each of the first flexible members and each of the second flexible members encased in a package to form a flexible support unit, and a first bearing point in a stretchable direction of each of the first flexible members connecting to the bed surface and a second bearing point in a stretchable direction of each of the first flexible members connecting to the bottom surface to support a weight from the bed surface; and a foundation having a moving plate and a lifting device within and supporting the bottom surface of the carrier, the moving plate supporting bottoms of the second flexible members and being driven by the lifting device upward and downward to change positions of the bottoms of the second flexible members and adjust a supporting force of the mattress through the second flexible members.

2. The adjustable mattress of claim 1, wherein both the first flexible members and the second flexible members are springs.

3. The adjustable mattress of claim 1, wherein one of the first flexible members is encased by a package and one of the second flexible members is also encased by an alternative package.

4. The adjustable mattress of claim 1, wherein the package is non-woven fabric.

5. The adjustable mattress of claim 1, wherein the first bearing point of each of the first flexible members connects to the bed surface with a first package, the second bearing point of each of the first flexible members connects to the bottom surface with a second package, the bed surface and the bottom surface are made of robust fabrics, the first package is adhered to the bed surface of the carrier, and the second package is adhered to the bottom surface of the carrier.

6. The adjustable mattress of claim 1, wherein the bottom surface of the carrier is a wire netting structure and the first flexible member is fastened onto the bottom surface by fastener components.

7. The adjustable mattress of claim 1, wherein the lifting device comprises a motor, bolts uniformly distributed in the foundation and screwed to the moving plate, and a controller used to control the motor to drive and turn the bolts and shift the moving plate toward or away from the carrier.

8. The adjustable mattress of claim 1, wherein the lifting device comprises a controller, a plurality of lead screws uniformly distributed on and penetrating the moving plate, a plurality of gasbags uniformly distributed under the moving plate, air manifolds, and an air compressor which is used to inflate or deflate the gasbags via the air manifolds so that the inflated gasbags lift the moving plate toward the carrier or the deflated gasbags allow the moving plate to move away from the carrier.

9. The adjustable mattress of claim 1, wherein the foundation has a plurality of crossbars disposed at interval on top edges of vertical walls of the foundation, and the crossbars support the bottom surface of the first flexible members, and the bottom of each of the second flexible members penetrates a space between two of the crossbars.

10. The adjustable mattress of claim 1, wherein the foundation has a height sensor detecting a shift of the moving plate between a current position and a position when the mattress is not used, and when the moving plate is lifted to a top position, the height sensor issues a signal to stop movement of the lifting device.

* * * * *